US006782560B1

(12) United States Patent
Ascherl et al.

(10) Patent No.: US 6,782,560 B1
(45) Date of Patent: Aug. 31, 2004

(54) PROTECTIVE SUIT

(75) Inventors: Rudolf Ascherl, Gerolfing (DE); Annemarie Eisinger, Ingolstadt (DE)

(73) Assignee: Krankenhauszweckverband Ingolstadt, Ingolstadt (DE)

( * ) Notice: Subject to any disclaimer, the term of this patent is extended or adjusted under 35 U.S.C. 154(b) by 0 days.

(21) Appl. No.: 09/371,808

(22) Filed: Aug. 11, 1999

(30) Foreign Application Priority Data

Aug. 14, 1998 (DE) ..... 198 36 892

(51) Int. Cl.[7] ..... A41D 13/00
(52) U.S. Cl. ..... 2/456; 2/69.5
(58) Field of Search ..... 2/456, 457, 458, 2/2.11, 2.14, 69, 695, 84

(56) References Cited

U.S. PATENT DOCUMENTS 2,008,919 A * 4/1935 Milkes ..... 5/343
2,227,751 A * 1/1941 Idelman ..... 2/69.5
2,675,552 A * 4/1954 Jackson ..... 2/69.5
3,412,407 A * 11/1968 Key ..... 2/69.5
4,677,696 A * 7/1987 Tanka ..... 2/84
4,790,040 A * 12/1988 Grillot et al. ..... 5/413
5,960,480 A * 10/1999 Neustater et al. ..... 2/456
5,985,431 A * 11/1999 Oosedo et al. ..... 428/297.4
5,991,921 A * 11/1999 Saito ..... 2/69
6,003,749 A * 12/1999 Sabo ..... 2/69.5
6,012,179 A * 1/2000 Garrett et al. ..... 2/456
6,040,251 A * 3/2000 Caldwell ..... 442/123

FOREIGN PATENT DOCUMENTS

| | | |
|---|---|---|
| DE | 7500349 | 11/1974 |
| DE | 8703376 | 5/1988 |
| GB | 2269086 | 9/1994 |

* cited by examiner

*Primary Examiner*—John J. Calvert
*Assistant Examiner*—Tejash Patel
(74) *Attorney, Agent, or Firm*—Dority & Manning

(57) ABSTRACT

A method and apparatus for providing a protective enclosure is provided. The protective enclosure is used to form a fabric barrier surrounding a patient to prevent contamination from the patient from spreading. The protective suit provides access panels so that a limited area of the patient may be accessed for treatment purposes. The method and apparatus allows a patient to be retained within the protective suit during transport and while receiving treatment. The protective suit thereby limits the spread of contamination to the surrounding environment, including health care personnel and diagnostic machinery.

27 Claims, 4 Drawing Sheets

PROTECTIVE SUIT

The present invention relates to a process for the insulation of contagious patents as well as to a protective suit for contagious patients.

For approximately one year now it has been observed that more and more patients enter hospitals with germs which are extensively resistant to antibiotics. It is a fact with the increased feeding with admixtures of antibiotics in animal husbandry, these are deposited in the flesh of the animals and enter humans with the absorption of food. As a result antibiotics become ineffectual in more and more people because the body has become accustomed to them and also because the bacteria and germs are resistant. These germs and bacteria can therefore be overcome only through very expensive special treatment. The problem is on the increase in hospitals, so that such patients must be received in special stations so that other patients may not be infected. Very strict and special disinfection measures must be applied to the personnel as well as to the material equipment of such stations, such as bed linen, etc.

When such patients are brought from the special station into a treatment room for x-rays, for instance, for nuclear spin tomography and other treatments, the danger exists that these bacteria may be transmitted to personnel or to the conveying means and also on the treatment apparatus through contact with contaminated patients, so that very work-intensive and expensive disinfection must be applied after every utilization by such a patient.

It is therefore the object of the present invention to find ways and means to prevent such a contamination to the greatest extent possible and thereby to avoid the disinfection effort, or at least to reduce it considerably.

The solution according to the present invention consists in enclosing the patient before the treatment to be performed in a protective suit in form of a length of fabric. This suit remains closed during the entire treatment and the transportation. However this protective suit can also be opened partially or entirely insofar as this is necessary for the treatment, and be closed following the treatment. To put on the protective suit it is opened into a cohesive length of fabric, the patient is placed on the surface thus formed and the protective suit is closed so as to envelop the patient. It is however also possible to lay the protective suit in form of a length of fabric over the patient including his bedding, with the head being placed in a hood with a cut-out for the face. This has the advantage that following operations or under conditions where the patient may not be moved, he is enveloped and thus contamination is prevented.

The protective suit according to the invention is provided with closures and is cut so that in its open state the protective suit represents a length of fabric on which the patient is placed and the patient is wrapped in this length of fabric which is adapted to his body with the closures being closed. The protective suit can envelop the patient entirely or can be adapted to individual limbs. For its transportation function alone, it suffices and is preferable for the patient to be entirely enveloped by the protective suit without adaptation of the protective suit to individual limbs. For treatment purposes however it has been shown to be preferable e.g. to provide two separate leg pockets or sleeves with sleeve extensions or other closable openings in order to render certain parts or areas of the body and/or the limbs accessible for the treatment. To ensure that the patient is enveloped as much as possible also during the treatment, a separate pocket is provided for each leg, which can be opened independently of the other leg pocket. The cut is such that the side on which the patient lies when the protective suit is opened constitutes a closed surface so that the treatment table cannot be contaminated. For x-ray or nuclear spin tomography it is important that the closures of the protective suit should not be magnetized, in particular also not metallic. Therefore Velcro or zipper closures made of plastic are preferably used.

So as to be able to envelop also a patient with no mobility, a protective suit can be made in form of a length of fabric which is placed over the patient including his bedding, with the head being placed in a hood with a cutout for the face. In order to be able to open this protective suit also for treatment purposes, appropriate closing openings are provided.

Finally it is important for the protective suit to b made of a fabric which is insulating germs or cocci. A fabric made of micro fibers has proven to be especially useful especially due to its washability, so that the protective suit can be re-used many times.

Protective suits as such are not new and are used for the most diverse purposes. Thus DE 87 03 376 U1 discloses a one-piece treatment suit which is intended to prevent incontinent and disoriented persons from removing their diaper inserts. This suit has zippers to cover the protective suit with a cover and for the possibility to uncover the problem zone to clean the care recipient. The zippers can only be actuated by means of a special hook key so that the care recipient may not be able to open them himself The suit should nevertheless afford the care-recipient wearer freedom of movement as with a garment. However this suit is not suitable as a protective suit for contagious patients, in particular because it is difficult to put on bed-ridden and sick patients who are restricted in their movements. Furthermore the danger exists that the care-taking personnel may itself become contaminated when helping with the putting on of the suit.

A patient surgery suit is also known from DE 75 00 349 U1 which in addition to protection from cooling after surgery is also designed to prevent the emission of germs by the patient's skin into the surrounding air of the operating room. This is however a completely closed suit which must be put on b the patient himself. As its only opening for this, an overlapping incision is provided. For access during surgery, appropriate openings are cut into the suit which is conceived for a one-time use. Aside from the fact that repeated use of this suit is not possible and that the patient must always able to put on this suit himself, this protective suit has the disadvantage that the cut openings can no longer be closed so that no contamination protection is afforded at these locations.

Compared with the state of the art, the new and special feature of the protective suite according to the invention is that it is made in form of a length of fabric with closures on which the patient is placed or which is spread out over the patient, and that the patient is wrapped into this length of fabric. As a result the protective suit is easily put on, even with patients with limited or lost mobility, without contamination of the care-taking personnel.

Additional details of the invention are described through the drawings.

Figure 1:
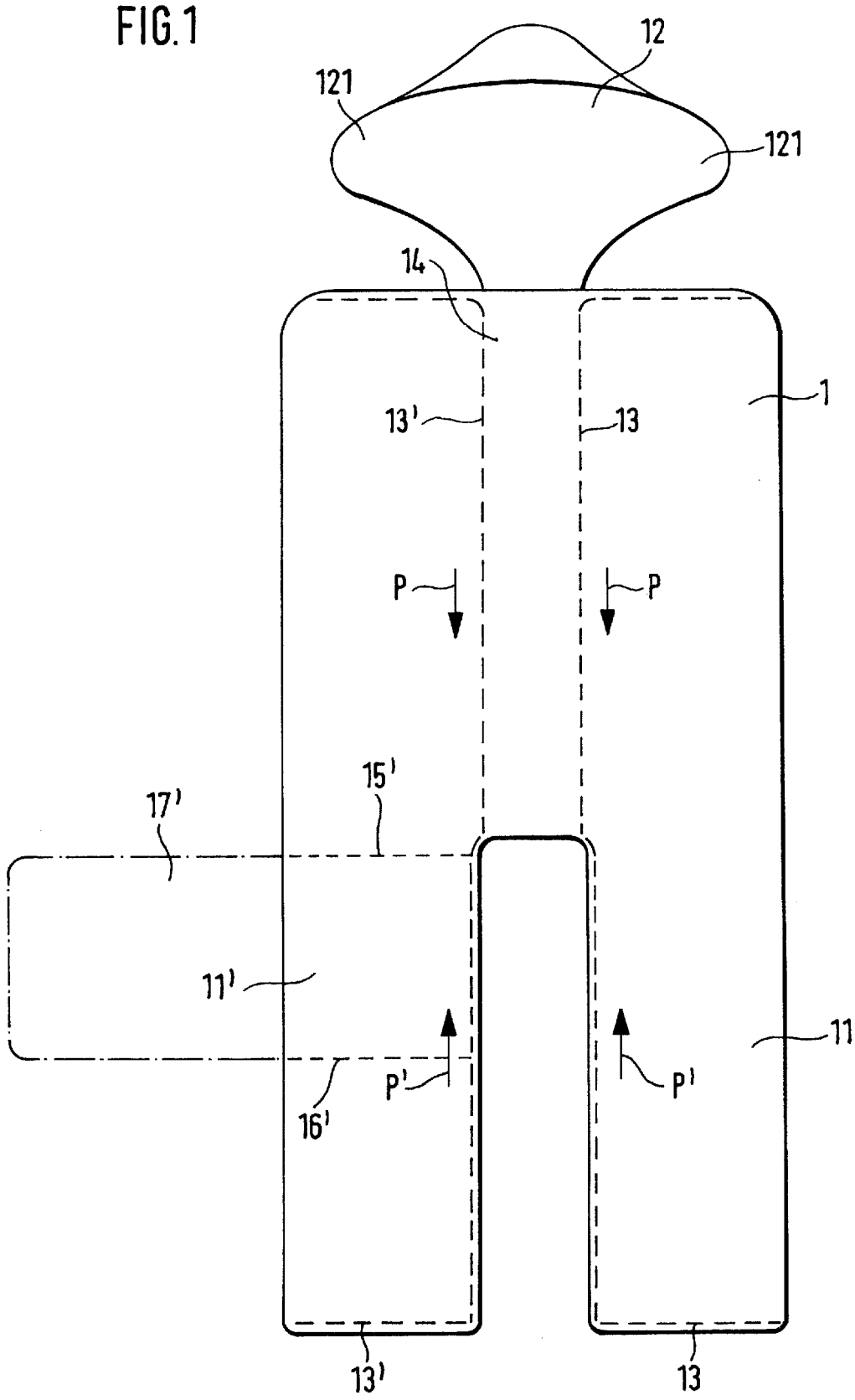
FIG. 1 shows a protective suit in its closed state, with zippers.

The protective suit (1) of FIG. 1 is a shown closed and has leg sections (11) and (11'). Zippers (13) and (13') are provided and include a central piece (14) in the upper portion of the protective suit (1). The zippers (13 and 13') are opened in the direction of the arrows, continuously and beyond the end of the leg sections (11 and 11') so that the latter can be opened completely into a coherent surface. The center portion (14) is then folded in between the leg sections (11 and 11') so that a closed surface is again created on which the patient lies when also the parts (11, 11' and 14) of the protective suit (1), freed by the zippers (13, 13') are unfolded. The zippers (13 and 13') extend so far out on the lower and upper border of the protective suit (1) that a complete opening of the protective suit (1) is possible. The protective suit (1) may also be provided with a hood (12) which can be cut in one part with the suit or may also be attached by means of a zipper. The hood (12) has flaps (121) on either side which can cover the sides of the head so that the entire patient is enveloped with the exception of the face. For this purpose a pull string (122) (FIGS. 3 and 4) can be provided additionally on the edge of the hood, so that the hood (12) can be closed as a head protection up to a narrow section for the face. Such pull strings (122) can also be provided on openings for legs and arms in order to close these openings tightly around the limbs.

The handling of the protective suit (1) is very simple and it can also be used for patients who are unable to don the protective suit (1) by themselves. The open protective suit (1) is first laid over the bed or the gurney, and the patient then lies down on it or is laid down on this support. The open side or leg sections (11, 11') are then draped over the patient and the zippers (13 and 13') are zipped up in the direction opposite to the arrows (P). The head then lies on the hood (12) which is also closed by means of Velcro closures and/or pull strings (122) so that the face remains free. In this wrapped state the patient can be transported or can be placed on the X-ray table. It is only important in that case that no metal parts are used in producing the protective suit (1), as this would interfere with the X-ray procedure. For this reason zippers are used which are made of a non-metallic material, preferably plastic. The division of the protective suit (1) into the leg sections (11 and 11') has the advantage that the limbs which are enclosed in the protective suit (1) are clearly visible so that treatment is simplified, e.g. when only one leg is to be X-rayed. The case may however also present itself where a different treatment is to be performed on the leg for which an opening of this leg section (11 or 11') is required. It is then advantageous not to use a continuous zipper (13 or 13') but to provide the zippers so that each of the leg sections (11 or 11') can be opened independently of the other leg section, e.g. also in order to render the foot accessible for treatment. The zipper (13) can therefore be divided so that only the leg section (11) can be opened. If e.g. the lower part of the zipper (13 or 13') is to be opened in the direction of arrow (P'), it is possible to bare only the foot or the calf without having to open the entire protective suit (1). This lower part of the zipper (13 or 13') reaches from foot to crotch, while the upper part of the zipper (13 or 13') starts at the throat and ends at the crotch, with the opening in the direction of arrow (P). This has the advantage that the body part of the protective suit (1) can be opened independently of the leg sections (11 and 11'). Of course a continuous zipper (13 or 13') can also be opened in the direction of the arrow (P'). This requires however that one leg section (11 or 11') must always be opened at the same time with the body part.

An opening in the entire or one leg section in part or entirely is provided for the protective suit (1) described through FIG. (1). It is however possible to lay out the zippers so that also other parts of the body or limbs become accessible for special treatment while the patient as such remains covered.

For this reason additional zippers (15' and 16') are provided in order to uncover only the foot or the leg or also only the upper thigh. When the zipper (15' or 16') which reaches as far as the edge of the protective suit is opened, this part (17 or 17') of the protective suit (1) can be opened to the side so that a continuous length of fabric is maintained as support even at the open location. Following treatment, the part (17') of the protective suit (1) is folded over again and is closed by means of the zippers (15' and 16'). Such partial openings can also be provided to bare the arm or part of the arm.

Figure 2:
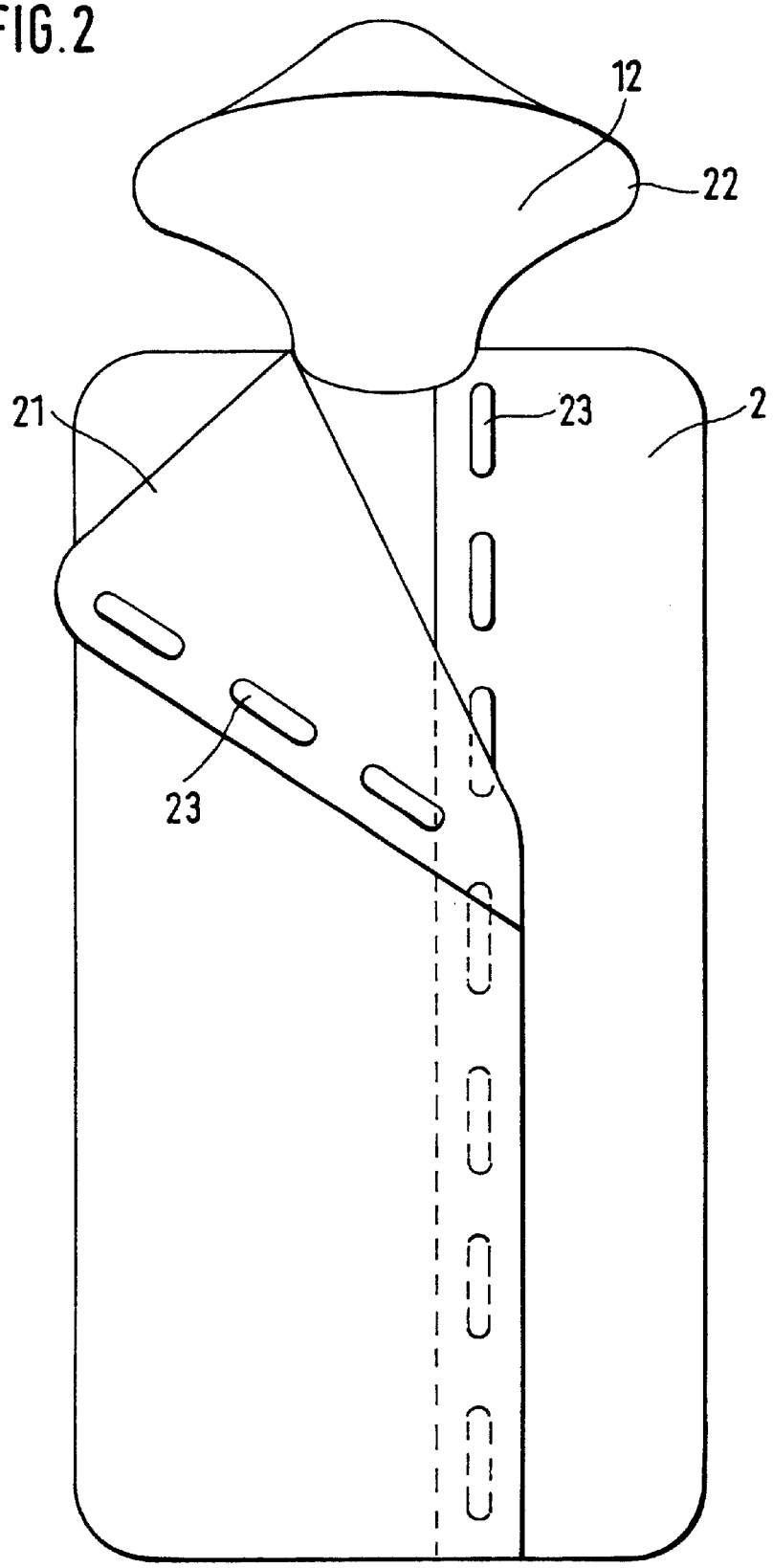
FIG. 2 shows another embodiment of the protective suit, partially open, with Velcro fastener.

FIG. 2 shows another embodiment of a protective suit (2) which envelops the entire patient without delimitation of the limbs. Velcro closures (23) are provided as closures. These are provided in pieces, as a continuous Velcro closure is difficult to close without shifting. Furthermore such shifting causes undesirable openings to appear.

In order to make perfect closing possible with easy handling, such a fastening seam consisting of individual Velcro closures (23) as shown in FIG. 2 can also be provided, the edge held with Velcro closures then being rolled over and the closure seam then being held by an additional Velcro connection. Such a rolled closure is noted for special tightness and stability in spite of simple handling.

The protective suit (1) is cut so that the patient need not pull it on but so that he is wrapped into it from head to foot. This means that the protective suit 1, 2 or 3 is spread out open into a length of cloth and is placed on the bed or on the gurney so that same may not be contaminated by the patient. The patient is then placed on the open protective suit and is wrapped in same, whereby the protective suit is closed germ-tight by means of zippers or Velcro closures. In the embodiment of FIG. 2 the patient is covered entirely, i.e. the protective suit (2) is made like a sleeping bag in which the individual limbs are not taken into account and separated by the cut. To cover the head, a hood (12) is provided which is laid around the head with its flaps (22). Velcro closures(23) are used to close the protective suit.

The closures must hold securely, may not open by themselves but should on the other hand well support disinfection through laundering and disinfectants, and especially for nuclear spin tomography examinations, may not contain any metal parts.

As mentioned earlier, the protective suit must be suitable for treatment. This means that the material may not interfere with treatment or examination with respect to magnetism (nuclear spin tomography) and to radiographic examinations and X-rays. This applies in particular to the closures. It is e.g. also possible to lead IV lines through the suit to the patient's IV needle. So that the patient need no longer be touched during the IV. Velcro closures (23) as shown in FIG. 2, where the IV line is passed through between the individual parts is especially well suited for this, as shown in FIG. 2.

Figure 3:
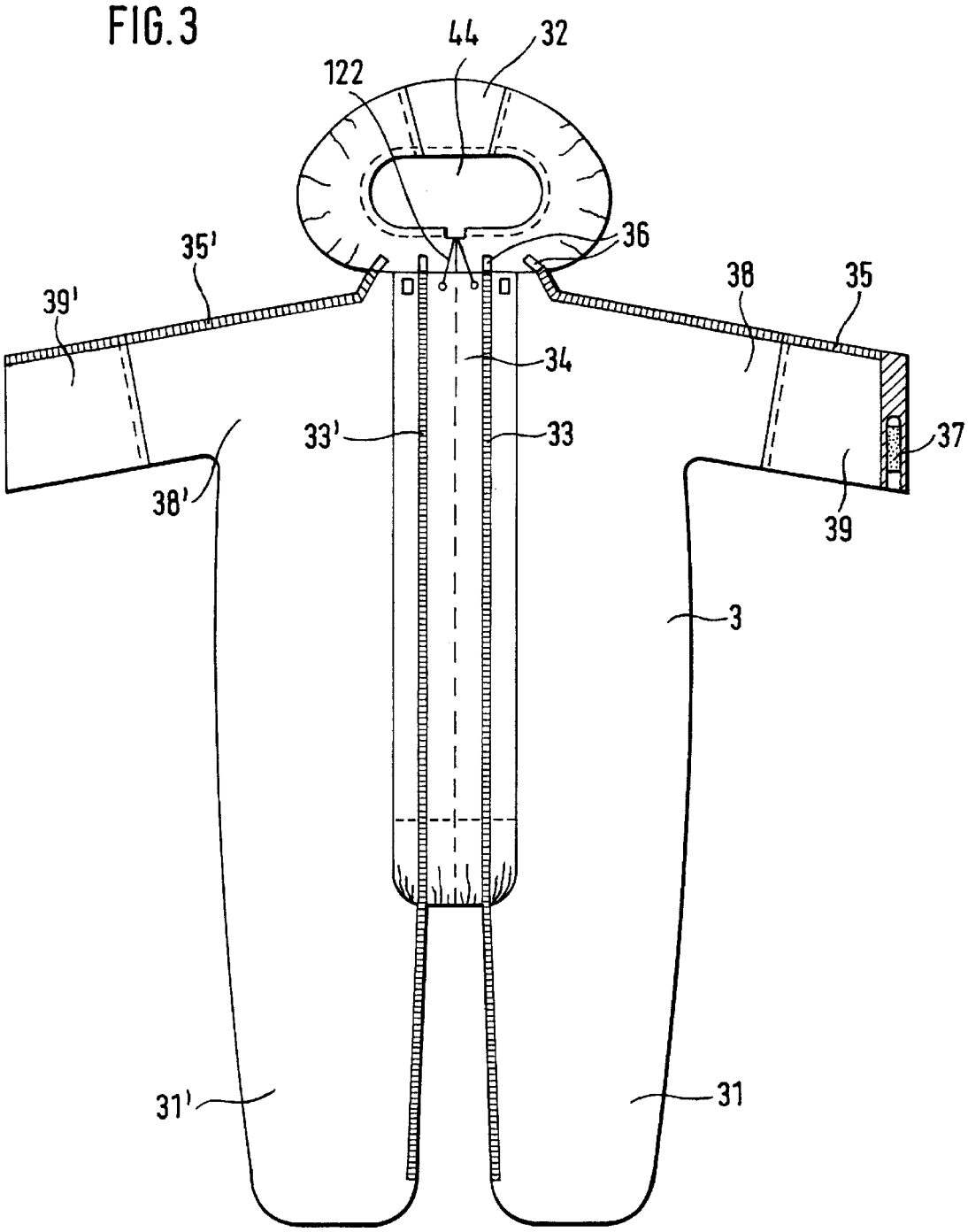
FIG. 3 shows a protective suit with zippers and with leg sections and sleeves.

FIG. 3 shows another embodiment of the protective suit, whereby the protective suit (3), analogous to FIG. 1, is provided with zippers (33, 33') as well as with a center portion (34). In addition, sleeve (38) and sleeve extensions (39, 39') are provided which can be closed with a Velcro strip (37) or a draw string (122). The top parts of the sleeves (38 or 38') can be opened or closed continuously by a zipper (35 or 35'), so that when the zippers (35 and 33) are opened they can be opened into a continuous surface on which the patient can be placed and can be wrapped. The arrows (P) indicate the best direction for the opening of the zippers. The hood (32) is provided collar shackles (36) in form of Velcro closures which can be attached to the neck part of the protective suit (3). Instead of the flaps (121) (FIG. 1 or 2) a drawstring (122) is provided which pulls the hood (32) together, leaving an opening (44) for the face. This protective suit (3) can also be provided with different openings that can be closed in order to render individual parts or areas of the body or limbs accessible for treatment, as shown in FIGS. 1 and 4, for example.

Figure 4:
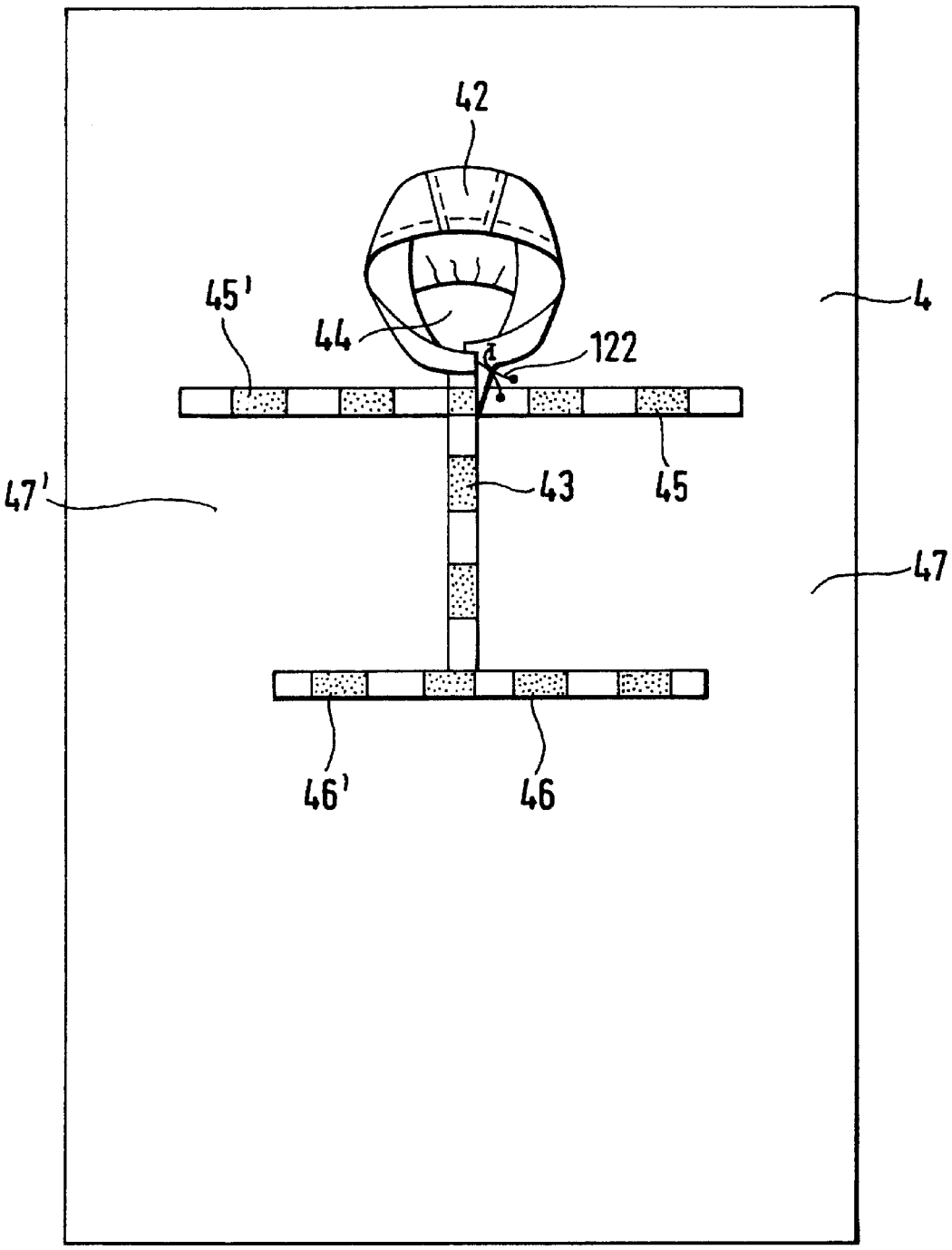
FIG. 4 shows a protective suit designed to envelop the patient together with his bedding.

FIG. 4 shows a different type of protective suit according to the invention, in which the patient is not placed on the open protective suit to be wrapped into it; the protective suit (4) is made in form of a length of fabric which is laid over the patient and his bedding. For the head a hood (42) is provided in the length of cloth which receives the head and has an opening (42) for the head which can be adapted to the face by means of a pull string (122). In order to make here too individual parts or areas of the body or of the limbs accessible for treatment, openings are provided which can be opened and closed again e.g. by Velcro closures (45, 45', 43, 46 and 46'). The part (47 or 47') can be flipped open to the side by opening the central Velcro closure (43) and the two Velcro closures (45 and 46) or (45' and 46'), whereby the cohesive length of fabric is maintained. Following treatment the part (46 or 47') is folded over again and is closed with the closures (43, 45 and 46 or 45' and 46') Additional openings can of course also be provided in the protective suit (4), e.g. in order to make arms or legs accessible. This type of protective suit (4) has the advantage that the patient need not be laid down on the open protective suit to be wrapped in it, and this is essential with patients incapable of movement due to anesthesia or injury.

The improvement of the present invention provides for a method of wrapping a patient in a protective barrier comprising: supplying a protective suit defining a receiving surface; placing a patient upon the receiving surface; folding a first leg section over a first leg of the patient; securing an upper segment of the folded first leg section to a lower leg segment of the first leg section along a common seam defined by the respective edges of an upper leg segment and the lower leg segment; folding a second leg section over a second leg of the patient; securing an upper segment of the folded second leg section to a lower leg segment of the second leg section along a common seam defined by the respective edges of the upper leg segment in the lower leg segment; placing a central panel defined by the protective suit across a mid-torso region of the patient; securing the mid-torso panel to respective side portions of the protective suit; wherein the patient's body is enclosed within the protective suit which protects contamination by the patient of the immediate environment.

A suitable protective suit may be provided by a rectangular fabric panel defining a plurality of re-closeable openings, each re-closeable opening formed by a flap defined within the panel, each flap having a first closure mechanism defined along an overlapping edge region between an edge of the flap and further defined by an edge of the panel surrounding the flap; a second closure mechanism for engaging at least a portion of at least of one said plurality of flaps when the flap is positioned to form an enclosure adapted for covering a portion of a patient's body.

An alternate barrier for bed-ridden or comatose patients may comprise a fabric panel defining an aperture therethrough, the aperture in communication with a hood defined along an upper surface of the panel and surrounding the aperture; the aperture and the hood adapted for receiving a patient's head when a lower surface of the fabric panel is placed over the patient; a re-closeable flap defined by the fabric panel, the flap being positionable away from the fabric panel and providing access therethrough; wherein, when a lower surface of the fabric panel is placed over a reclining patient, the aperture and hood region is adapted for engaging the head of the patient while the re-closeable flap permits access to an additional position of the patient.

The fabric used for protective suits consists of a bacteria-insulating material which is capable of breathing but impermeable to water. For protective suits already tested, a fabric made of micro fiber has been used. This fabric has proven in tests to be capable of insulation against bacteria and germs. This fabric has also perfectly survived several disinfection treatments, e.g. boiling in the laundry among others, without losing any of its insulating capabilities.

A material which has been proven to be suitable for the protective suit according to the invention in tests has the following specifications:

Web weave Linen 1/1
Weight: 13 g/m$^2$
Material: 100% PES Micro

| | Warp | Weft |
|---|---|---|
| threads per cm | 60 | 30 |
| Thickness: | Nm 100 | Nm 60 |

The invention has great economic and medical significance. In the past, the expenditure for disinfection has been considerable. In this manner great savings an be achieved. The protective suit according to the invention is easily adaptable to almost all situation and is therefore suited for multiple usage. It is simple to manufacture and above all reusable many times. It has been found that the problem of resistant cocci or germs can be solved with surprising success in this manner, and with little expenditure.

List of References Characters

| | |
|---|---|
| 1, 2, 3, 4 | Protective suit |
| 11, 11', 31, 31' | Leg section |
| 12, 32, 42 | Hood |
| 121 | Flap |
| 122 | Draw string |
| 14, 34 | Central part |
| 13, 13', 15', 16', 33, 33', 35, 35' | Zippers |
| 17, 17', 47, 47' | Openings |
| 23, 43, 45, 45', 46, 46' | Velcro closures |
| 22 | Flap |
| 21 | Opening |
| 38 | Sleeve |
| 39, 39' | Sleeve extension |
| 36 | Collar shackle |
| 37 | Velcro band |
| 44 | Opening for face |
| P, P' | Opening direction for zipper |

What is claimed is:

1. A method of preventing the spread of a pathogen from a patient comprising:

supplying a protective panel comprising a bacteria-insulating microfiber fabric, said microfiber fabric being vapour permeable and liquid impermeable, said panel having a substantially planer receiving surface, and defining at least one reversible closure to provide access to a torso or limb region of a patient;

operatively engaging said patient with said receiving surface; and, enclosing said patient within said protective panel, thereby protecting an immediate environment surrounding the patient from contamination by the patient.

2. The method according claim 1 wherein the step of operatively engaging said patient further comprises placing the patient upon the receiving surface.

3. The method according to claim 2 wherein said step of enclosing said patient further comprises folding a first side section of said protective panel over a portion of the patient;

folding a second side section of said protective panel over a portion of the patient and against said first side section; and, securing the folded second side section upon the first side section.

4. The method according to claim 1 wherein said step of operatively engaging the patient further comprises placing said receiving surface over a front of the patient.

5. The method according to claim 4 wherein said step of placing said receiving surface over a front of the patient further comprises a subsequent step of additionally placing the receiving surface over a bedding of the patient, thereby enclosing the bedding and patient within said protective panel.

6. The method according to claim 4 comprising the additional steps of selectively opening one of said at least one reversible closure thereby providing access to a patient for treatment; and, re-closing said reversible closure following treatment.

7. The method according to claim 1 wherein said protective panel further comprises a vapour permeable, water impermeable fabric.

8. The method according to claim 4 wherein said step of placing said receiving surface over a front of the patient further defines placing an aperture defined within an interior region of said protective panel opposite a face of the patient.

9. The method according to claim 1 wherein said panel further defines an adjustable hood region which is reversibly attached to an edge of said panel.

10. A method of preventing the spread of a pathogen from a patient comprising:

supplying a protective panel comprising a bacteria-insulating microfiber fabric, said microfiber fabric being vapour permeable and liquid impermeable, said panel having a substantially planer receiving surface, and defining at least one reversible closure to provide access to a torso or limb region of a patient, wherein said protective panel further defines a plurality of extensions, each said extension adapted for forming into a pocket for securing around a limb of the patient; and operatively engaging said patient with said receiving surface; and, enclosing said patient within said protective panel, thereby protecting an immediate environment surrounding the patient from contamination by the patient.

11. The method according to claim 10 comprising the additional steps of opening a portion of the protective panel by unfolding at least one of said plurality of extensions, thereby providing access to a limb of the patient for re-closing said at least one extension following treatment.

12. A protective barrier for use by a contagious or contaminated patient comprising:

a substantially planer panel comprising a woven bacteria-insulating microfiber fabric, said panel being vapour permeable and water impermeable and defining a receiving surface adapted for placement about a patient said fabric panel further comprising a plurality of refastenable flaps, each said refastenable flap being adapted for partial disengagement from said panel so as to provide access to a region of the patient's body beneath the flap; and a reversible closure for securing said fabric panel into an enclosure which surrounds a patient.

13. The protective barrier according to claim 12 wherein the reversible closure allows selective reopening of the panel to provide access to a limited region of the torso or the limb region of a patient.

14. The protective barrier according to claim 12 wherein the reversible closure is selected from the group consisting of a hock and loop fastener, a non-metallic zipper, and a drawstring.

15. The protective barrier according to claim 14 wherein said hook and loop fastener is provided as a plurality of discontinuous pieces.

16. The protective barrier according to claim 12 wherein said fabric panel further comprises a hood region for placement about a head of a patient.

17. The protective barrier according to claim 16 wherein said hood region is opposite an aperture defined by an interior portion of said panel.

18. The protective barrier according to claim 16 wherein said hood is detachable from said panel.

19. The protective barrier according to claim 12 wherein said fabric panel is provided by a woven PES microfiber.

20. A substantially planer panel comprising a woven microfiber fabric, said panel being vapour permeable and water impermeable and defining a receiving surface adapted for placement about a patient, said panel further defining a main portion and a first extension adapted for forming a pocket surrounding a first limb of a patient and a second extension adapted for forming a pocket surrounding a second limb of a patient, each of said first and said second extensions further defining a refastenable flap therein, each said refastenable flap adapted for partial disengagement from said respective extension so as to provide access to a region beneath said flap.

21. The protective panel according to claim 20, wherein said main portion of said panel further defines a recloseable opening to make accessible regions of the body for a treatment.

22. The protective panel according to claim 21, wherein the protective panel is adapted to single limbs.

23. The protective suit according to claim 20, wherein the side to rest on remains a closed surface even if the openings provided for a treatment are opened.

24. The protective panel according to claim 20, wherein the planer panel has openings for passing through infusion lines.

25. The protective panel according to claim 20, wherein an interior of said panel defines an aperture, said aperture adapted for placement about a head region of the patient.

26. A substantially planer panel comprising a woven microfiber fabric, said panel being vapour permeable and water impermeable and defining a receiving surface adapted for placement about a patient, said panel further defining a main portion and a first extension adapted for forming a pocket surrounding a limb of a patient and a second extension adapted for forming a pocket surrounding a limb of a patient, each of said first and said second extensions further defining a refastenable flap therein, each said refastenable flap adapted for partial disengagement from said respective extension so as to provide access to a region beneath said flap, wherein the protective panel is adapted to single limbs and each of said first extension and said second extension form a pocket for surrounding a leg of a patient.

27. A substantially planer panel comprising a woven microfiber fabric, said panel being vapour permeable and water impermeable and defining a receiving surface adapted for placement about a patient, said panel further defining a main portion and a first extension adapted for forming a pocket surrounding a limb of a patient and a second extension adapted for forming a pocket surrounding a limb of a patient, each of said first and said second extensions further defining a refastenable flap therein, each said refastenable flap adapted for partial disengagement from sad respective extension so as to provide access to a region beneath said flap, wherein separate pocket is provided for each leg and can be opened independently of the other leg pocket.

* * * * *